US009198463B2

(12) United States Patent
Liu

(10) Patent No.: US 9,198,463 B2
(45) Date of Patent: Dec. 1, 2015

(54) ELECTRONIC CIGARETTE BOX

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 84 days.

(21) Appl. No.: 13/956,785

(22) Filed: Aug. 1, 2013

(65) Prior Publication Data

US 2014/0374289 A1 Dec. 25, 2014

(30) Foreign Application Priority Data

Jun. 19, 2013 (CN) ..... 2013 2 0353425 U

(51) Int. Cl.

| | |
|---|---|
| ***A24F 15/00*** | (2006.01) |
| ***A24F 15/12*** | (2006.01) |
| *A24F 47/00* | (2006.01) |

(52) U.S. Cl.

CPC ..... *A24F 15/12* (2013.01); *A24F 47/008* (2013.01)

(58) Field of Classification Search

CPC ..... A24F 15/12
USPC ..... 206/242, 265, 266, 268, 269, 274
See application file for complete search history.

(56) References Cited

U.S. PATENT DOCUMENTS

| | | | | |
|---|---|---|---|---|
| 5,810,164 | A * | 9/1998 | Rennecamp | 206/256 |
| 2013/0140200 | A1* | 6/2013 | Scatterday | 206/265 |
| 2013/0228191 | A1* | 9/2013 | Newton | 131/329 |

* cited by examiner

*Primary Examiner* — Anthony Stashick
*Assistant Examiner* — Raven Collins
(74) *Attorney, Agent, or Firm* — Tim Tingkang Xia, Esq.; Locke Lord LLP

(57) ABSTRACT

An electronic cigarette box is provided in the present invention. The electronic cigarette box is configured for receiving electronic cigarettes, and the electronic cigarettes define spiracles for gas circulation. The electronic cigarette box includes sealing devices corresponding to the spiracles, and the sealing devices are configured for sealing the spiracles.

15 Claims, 11 Drawing Sheets

ELECTRONIC CIGARETTE BOX

CROSS-REFERENCE TO RELATED APPLICATIONS

This non-provisional application claims priorities under 35 U.S.C. §119(a) on Patent Application No. 201320353425.1 filed in P.R. China on Jun. 19, 2013, the entire contents of which are hereby incorporated by reference.

FIELD OF THE INVENTION

The present invention relates to the field of household electrical products, and more particularly, relates to an electronic cigarette box.

BACKGROUND OF THE INVENTION

Referring to FIG. 1, a typical electronic cigarette box generally comprises a first box body 1 and a second box body 2 connected with the first box body 1. An electronic cigarette 10 is positioned between the first box body 1 and the second box body 2, and resists both the first box body 1 and the second box body 2. When the electronic cigarette 10 is stored in the electronic cigarette box, because two ends of the electronic cigarette 10 adopt structures resisting inner walls of bottom ends of the first box body 1 and the second box body 2 respectively, moisture in the air may enter internal of the electronic cigarette 10, which causes reservoir cotton of the electronic cigarette 10 to absorb water, and thus adversely affects quantity of smoke generated in use of the electronic cigarette 10 and using taste. Moreover, when the absorption of moisture of the electronic cigarette 10 exceeds the saturation of the reservoir cotton, tobacco tar may spill and cause function failures of components such as a battery assembly or a microphone assembly, which adversely affects normal use of the electronic cigarette 10.

SUMMARY OF THE INVENTION

The objective of the present invention is to provide an electronic cigarette box which can effectively avoid moisture in the air entering the electronic cigarette, aiming at the above-mentioned drawbacks of the electronic cigarette box in the prior art, electronic cigarettes storing in the electronic cigarette box in the prior art may cause the electronic cigarette absorbing moisture from the air and affect its normal use.

The technical solutions of the present invention for solving the technical problems are as follows: an electronic cigarette box configured for receiving electronic cigarettes, the electronic cigarettes defining spiracles for gas circulation; the electronic cigarette box includes sealing devices corresponding to the spiracles, and the sealing devices are configured for sealing the spiracles.

Advantageously, the electronic cigarette box comprises a first box body and a second box body connected with the first box body.

Advantageously, the electronic cigarette box comprises an inlet end received in the first box body; the spiracles comprise an inlet vent defined in the inlet end and configured for enabling air to flow into the electronic cigarette; the sealing devices comprise a first sealing device positioned between the electronic cigarette and the first box body; the first sealing device comprises a first sealing component connected with an inner wall of a bottom end of the first box body; a sealing groove opening towards one side of the electronic cigarette is defined in the first sealing component; and the inlet vent is positioned in the sealing groove.

Advantageously, a first card slot is defined in an end of the first sealing component that is near the inner wall of the bottom end of the first box body, and a first card buckle is formed on the inner wall of the bottom end of the first box body and buckles with the first card slot.

Advantageously, cross sections of both the first card slot and the first card buckle are T-shaped.

Advantageously, the first sealing component and the inner wall of the bottom end of the first box body are integrated together.

Advantageously, the first sealing component is made of anyone of plastic, silicone and rubber.

Advantageously, the electronic cigarette comprises an outlet end that is far away from an inner wall of an bottom end of the first box body; the spiracles includes an outlet vent defined in the outlet end and extending along an axial direction of the electronic cigarette, and the outlet vent is configured to vent smoke; and the sealing devices further comprise a second sealing device configured for sealing the outlet vent.

Advantageously, the second sealing device is a sealing column connected with the inner wall of the bottom end of the second box body; and the sealing column is received in the outlet vent.

Advantageously, the sealing column and the inner wall of the bottom end of the second box body are integrated together.

Advantageously, the sealing column is cylindrical, and matches with the outlet vent.

Advantageously, the sealing column is made of anyone of plastic, silicone and rubber.

Advantageously, the second sealing device comprises a second sealing component connected with the inner wall of the bottom end of the second box body; and one end of the second sealing component that is far away from the second box body resists an end surface of the outlet end mutually.

Advantageously, a second card slot is defined in one end of the second sealing component that is near the inner wall of the bottom end of the second box body; and a second card buckle is formed on the inner wall of the bottom end of the second box body and buckles with the second card slot.

Advantageously, cross sections of both the second card slot and the second card buckle are T-shaped.

Advantageously, the second sealing component and the inner wall of the bottom end of the second box body are integrated together.

Advantageously, the second sealing component is made of anyone of plastic, silicone and rubber.

Advantageously, the electronic cigarette further comprises an atomizer and a battery rod; the spiracles further comprise a via vent formed at a junction between the atomizer and the battery rod and configured for enabling air to flow into the electronic cigarette; and the sealing devices further comprise a third sealing device sleeved on the electronic cigarette and resisting with the via vent.

Advantageously, the electronic cigarette further comprises a casing pipe and a lamp cap mounted at one end of the casing pipe; the spiracles are formed at a junction between the lamp cap and the casing pipe and are configured for enabling air to flow into the electronic cigarette; and the sealing devices are sleeved on the electronic cigarette and resist with the spiracles.

When implementing the electronic cigarette box of the present invention, the following advantageous effects can be achieved: the electronic cigarette box uses the structure of the sealing device, which can effectively avoid moisture in the air entering the electronic cigarette, and prevent the moisture in the air from entering the reservoir cotton and affecting the using taste and quantity of smoke of the electronic cigarette, therefore, normal use of the electronic cigarette stored in the electronic cigarette box will not be adversely affected. Moreover, the electronic cigarette box adopts the structures of the first sealing device and the second sealing device, which can make the electronic cigarette be more firmly clamped between the first box body and the second box body, and does not cause the electronic cigarette stored in the electronic cigarette box to loose and generate noise and other interferences.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
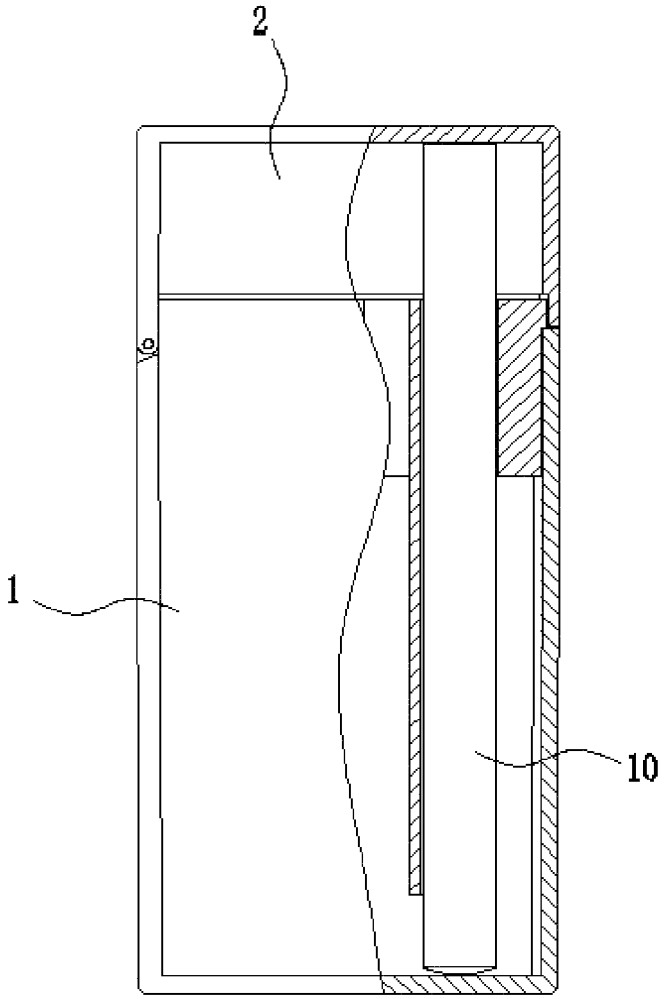
FIG. 1 illustrates a structure of an electronic cigarette box in prior art.
Figure 2:
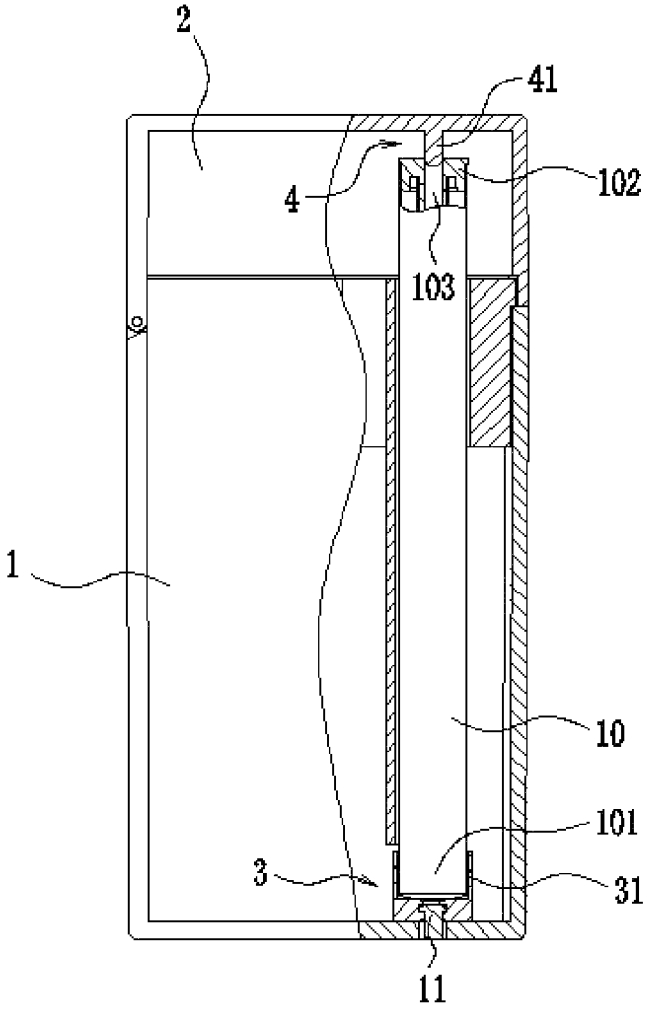
FIG. 2 is a structural schematic view of an electronic cigarette box of a first embodiment of the present invention.
Figure 3:
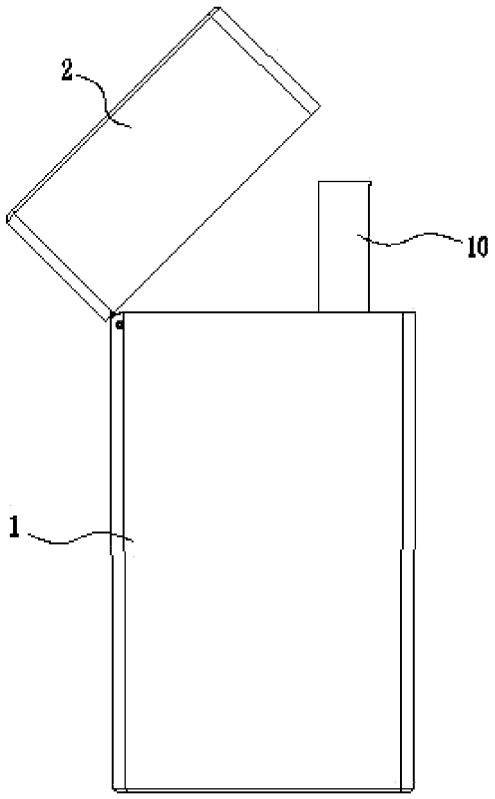
FIG. 3 is a structural schematic view of the electronic cigarette box shown in FIG. 2 in an opened state.

Referring to FIGS. 2 and 3, a first embodiment of the present invention provides an electronic cigarette box configured for receiving an electronic cigarette 10, wherein the electronic cigarette 10 defines spiracles for gas circulation. The electronic cigarette box includes sealing devices corresponding to the spiracles, and the sealing devices are configured for sealing the spiracles. Structures of the sealing devices of the electronic cigarette box can be adopted to seal the spiracles of the electronic cigarette 10, and thereby effectively avoid moisture in the air entering the electronic cigarettes and prevent the moisture in the air from entering reservoir cotton and affecting using taste and quantity of smoke of the electronic cigarette 10, such that normal use of the electronic cigarette 10 stored in the electronic cigarette box will not be affected.

Particularly, the electronic cigarette box comprises a first box body 1, and a second box body 2 connected with the first box body 1. The first box body 1 and the second box body 2 adopt mutually hinged structures. FIG. 3 is a structural schematic view of the electronic cigarette box shown in FIG. 2 in an opened state. Understandably, the first box body 1 and the second box body 2 can also adopt other connection structures, such as other hinge structures, detachable fastening connection structures, and so on.

The electronic cigarette 10 is received between the first box body 1 and the second box body 2. Structures of the first box body 1 and the second box body 2 are approximately cuboids. The sealing devices comprise a first sealing device 3 mounted between the electronic cigarette 10 and the first box body 1, and a second sealing device 4 mounted between the electronic cigarette 10 and the second box body 2. The structures of the first sealing device 3 and the second sealing device 4 of the electronic cigarette box can seal two ends of the electronic cigarette 10, and can effectively avoid the moisture in the air entering the electronic cigarette 10, so that the normal use of the electronic cigarette 10 stored in the electronic cigarette box will not be affected. Moreover, the structures of the first sealing device 3 and the second sealing device 4 adopted by the electronic cigarette box enable the electronic cigarette 10 to be clamped between the first box body 1 and the second box body 2 more steadily, and do not cause the electronic cigarette 10 stored in the electronic cigarette box to loose and generate noise and other interferences. Understandably, the electronic cigarette box can adopt only the structure of the first sealing device 3 or the structure of the second sealing device 4, and can also achieve the above functions.

Figure 4:
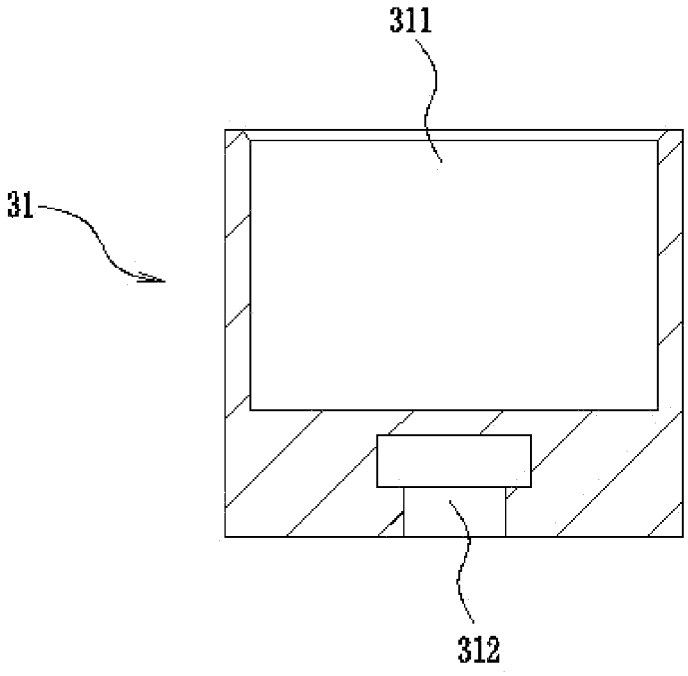
FIG. 4 is a structural schematic view of a first sealing component of the electronic cigarette box shown in FIG. 2.

Referring to FIG. 2, the electronic cigarette 10 comprises an inlet end 101 received in the first box body 1, and an outlet end 102 that is far away from an inner wall of a bottom end of the first box body 1. The first sealing device 3 comprises a first sealing component 31; and the first sealing component 31 is connected with the inner wall of the bottom end of the first box body 1. Referring to FIG. 4, a structure of the first seal component 31 is approximately cylindrical, and defines a sealing groove 311 with an opening towards one side of the electronic cigarette 10. The spiracles comprise an inlet vent defined in the inlet end 101 and configured for enabling air to flow into the electronic cigarette 10 (not shown in the figures), and the inlet vent is positioned in the sealing groove 311. Adopting the structure of the sealing groove 311 can take good effect of sealing the inlet vent, and can effectively avoid the moisture in the air entering the electronic cigarette 10 via the inlet vent. Understandably, the structure of the first seal component 31 is not limited to cylindrical, and it can also be cuboid, cube, prism, and so on.

Referring to FIGS. 2 and 4, in order to make the first sealing component 31 connected with the inner wall of the bottom end of the first box body 1 steadily, in this embodiment, a first card slot 312 is defined in the first sealing component 31 that is near the inner wall of the bottom end of the first box body 1. Correspondingly, a first card buckle 11 mutually buckling with the first slot 312 is formed on the inner wall of the bottom end of the first box body 1. Adopting the structures of the first card slot 312 and the first card buckle 11 can make the first sealing component 31 be detachably mounted on the inner wall of the bottom end of the first box body 1. In this embodiment, the cross sections of the first card slot 312 and the first buckle 11 are T-shaped, so that the first sealing component 31 can buckle with the inner wall of the bottom end of the first box body 1 more firmly. Understandably, the first card slot 312 and the first card buckle 11 can also adopt other structures, such as H beam shapes, dovetail structures, and so on.

In this embodiment, the above-mentioned first sealing component 31 can be made of any one of plastic, rubber, and silicone. The first sealing component 31 can also be made of EVA, wherein EVA is ethylene-vinyl acetate copolymer, which has good sealing performance, corrosion resistance, and so on. The first sealing component 31 is made of the above-mentioned materials, which makes sealing performance between the first sealing component 31 and the inlet end 101 good.

Referring to FIG. 2, the spiracles comprise an outlet vent 103 defined in the outlet end 102 and extending along the axial direction of the electronic cigarette 10, and the outlet vent 103 is configured for venting smoke. The second sealing device 4 is a sealing column 41 connected with the inner wall of the bottom end of the second box body 2. The structure of the sealing column 41 is cylindrical and matches with the outlet vent 103. When the sealing column 41 is inserted in the outlet vent 103, good sealing performance can be achieved. Adopting the sealing structure of column 41 can take a good effect on the sealing the outlet end 102, and can effectively avoid the moisture in the air entering the electronic cigarette 10 via the outlet vent 103. Understandably, the structure of the first sealing component 31 is not limited to be cylindrical, and it can also be cuboid, cube, prism, and so on. In this embodiment, the sealing column 41 and the inner wall of the bottom end of the second box body 2 adopt an integrated structure, the integrity effect of the sealing column 41 and the second box body 2 is good, and the connection performance is more stable and reliable.

In this embodiment, the sealing column 41 can be made of any one of plastic, rubber, and silicone. The sealing column 41 can also be made of the above-mentioned materials, which can achieve good sealing performance when the sealing column 41 is inserted in the outlet vent 103.

Figure 5:
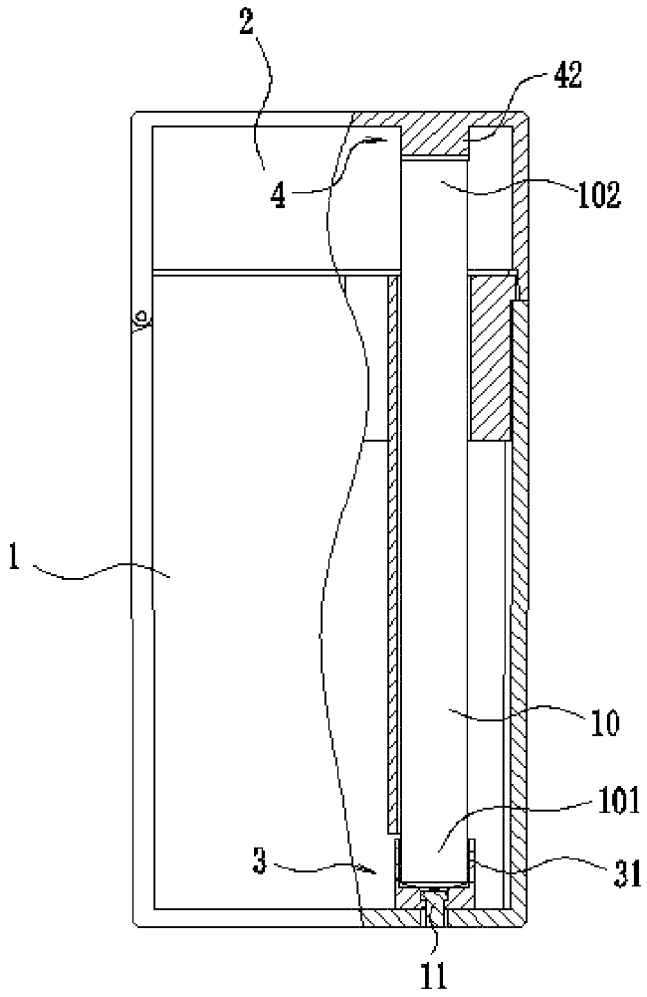
FIG. 5 is a structural schematic view of an electronic cigarette box of a second embodiment of the present invention.

Referring to FIG. 5, a second preferred embodiment of the present invention provides an electronic cigarette box, which differs from the electronic cigarette box of the first embodiment in the structure of the second sealing device 4. The second sealing device 4 comprises a second sealing component 42 connected with the inner wall of the bottom end of the second box body 2. The structure of the second sealing component 42 is approximately cylindrical, and one end of the second sealing component 42 that is far away from the second box body resists with an end surface of the outlet end 102 mutually. Adopting the sealing structure of the second sealing component 42 can take a good effect on sealing the outlet end 103, and can effectively avoid the moisture in the air entering the electronic cigarette 10 via the outlet vent 103. Understandably, the structure of the second sealing component 42 is not limited to be cylindrical, and it can also be cuboid, cube, prism, and so on. In this embodiment, the second sealing component 42 and the inner wall of the bottom end of the second box body 2 adopt an integrated structure, the integrity effect of the second sealing component 42 and the second box body 2 is good, and the connection performance is more stable and reliable.

In this embodiment, the above-mentioned second sealing component 42 can be made of anyone of plastic, rubber, and silicone. The second sealing component 42 can also be made of the above-mentioned materials, which make the sealing performance between the second sealing component 42 and the outlet vent 103 well.

Figure 6:
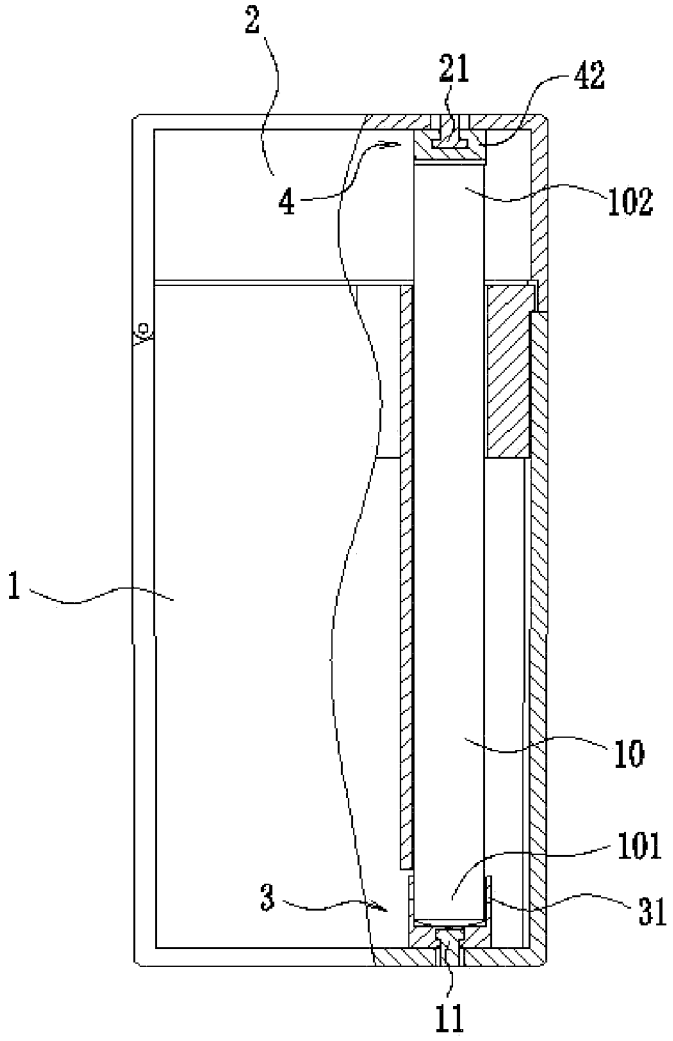
FIG. 6 is a structural schematic view of an electronic cigarette box of a third embodiment of the present invention.
Figure 7:
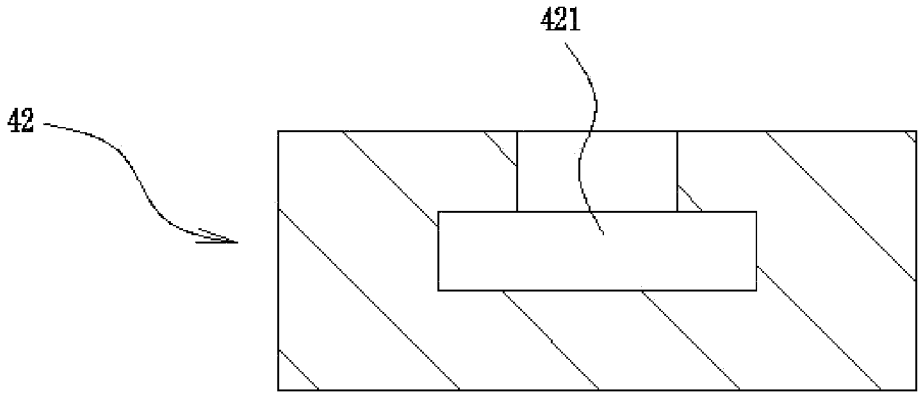
FIG. 7 is a structural schematic view of a second sealing component of the electronic cigarette box shown in FIG. 6.

Referring to FIGS. 6 and 7, a third preferred embodiment of the present invention provides an electronic cigarette box, which differs from the electronic cigarette box provided by the second embodiment in the connection structures of the second sealing component 42 and the inner wall of the bottom end of the second box body 2. In this embodiment, a second card slot 421 is defined in the end of the second sealing component 42 that is near the inner wall of the bottom end of the second box body 2. Correspondingly, a second card buckle 21 buckling with the second card slot 421 is formed on the inner wall of the bottom end of the second box body 2. Adopting the structure of the second card slot 421 and the second card buckle 21 can enable the first sealing component 42 to be detachably mounted on the inner wall of the bottom end of the second box body 2. In this embodiment, the cross sections of the second card slot 421 and the second card buckle 21 are T-shaped, so that the second sealing component 42 can buckle with the inner wall of the bottom end of the second box body 2 more firmly. Understandably, the first card slot 421 and the second card buckle 21 can also adopt other structures, such as H beam shapes, dovetail structures, and so on.

Figure 8:
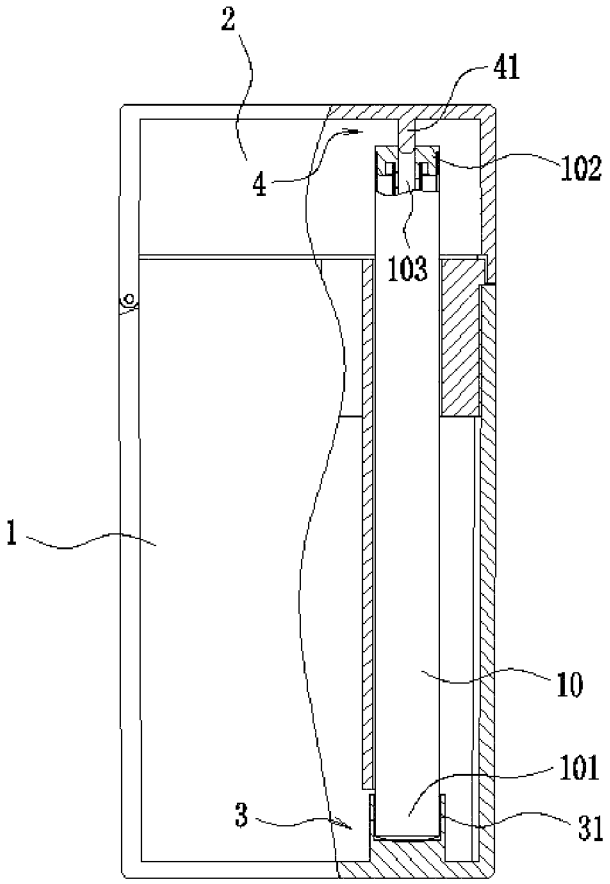
FIG. 8 is a structural schematic view of an electronic cigarette box of a fourth embodiment of the present invention.

Referring to FIG. 8, a fourth preferred embodiment of the present invention provides an electronic cigarette box, which differs from the electronic cigarette box provided by the first embodiment in the connection structures of the first sealing component 31 and the inner wall of the bottom end of the first box body 1. In this embodiment, the first sealing component 31 and the inner wall of the bottom end of the first box body 1 adopt an integrated structure, the integrity effect of the first sealing component 31 and the first box body 1 is good, and the connection performance is more stable and reliable.

Figure 9:
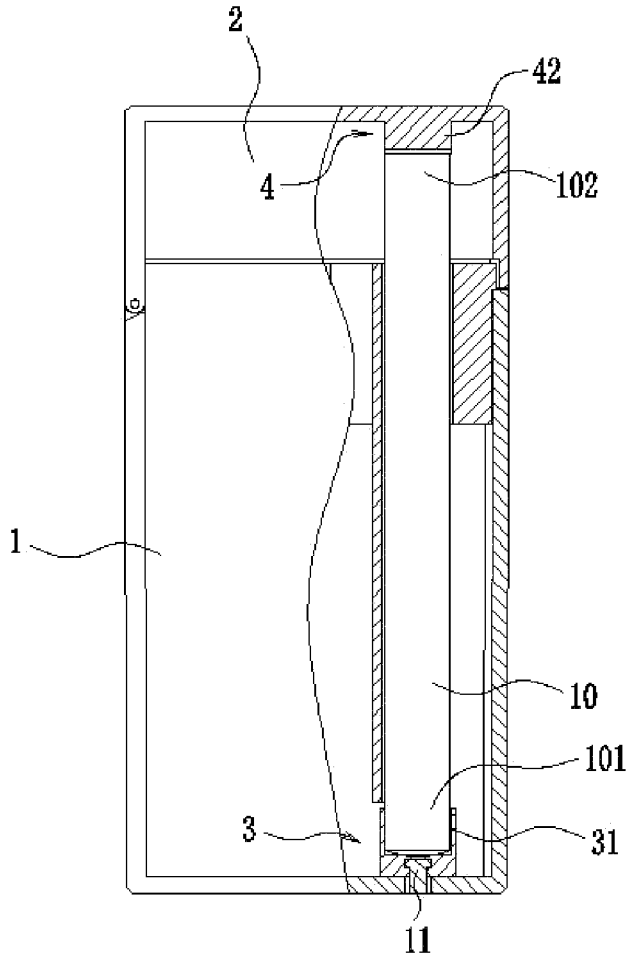
FIG. 9 is a structural schematic view of an electronic cigarette box of a fifth embodiment of the present invention.

Referring to FIG. 9, a fifth preferred embodiment of the present invention provides an electronic cigarette box, which differs from the electronic cigarette box provided by the third embodiment in the connection structures of the second sealing component 42 and the inner wall of the bottom end of the second box body 2. In this embodiment, the second sealing component 42 and the inner wall of the bottom end of the second box body 2 adopt an integrated structure.

Figure 10:
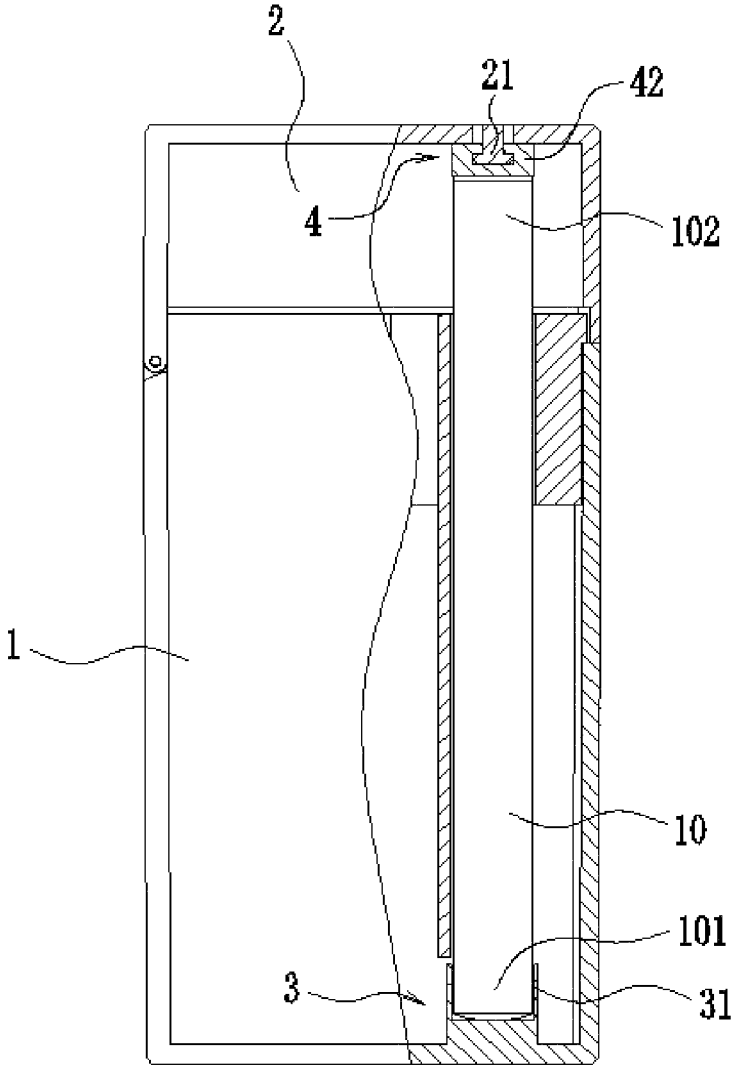
FIG. 10 is a structural schematic view of an electronic cigarette box of a sixth embodiment of the present invention.

Referring to FIG. 10, a sixth preferred embodiment of the present invention provides an electronic cigarette box, which differs from the electronic cigarette box provided by the third embodiment in the connection structures of the first sealing component 31 and the inner wall of the bottom end of the first box body 1. In this embodiment, the first sealing component 31 and the inner wall of the bottom end of the first box body 1 adopt an integrated structure.

In the above-mentioned embodiments, the connection structures of the first sealing component 31 and the first box body 1, the connection structures of the sealing column 41 and the second box body 2, and the connection structures of second sealing component 42 and the second box body 2 are not limited to the above-mentioned ways, and they can also adopt means of adhesive, thread connection, welding, and so on. Furthermore, one electronic cigarette is schematically received in the electronic cigarette box of each of the above-described embodiments. Understandably, more than one electronic cigarette can also be received in the electronic cigarette box, and more than one first sealing devices 3 and second sealing devices 4, with the number of which being equal to the number of the electronic cigarettes, are provided correspondingly.

Figure 11:
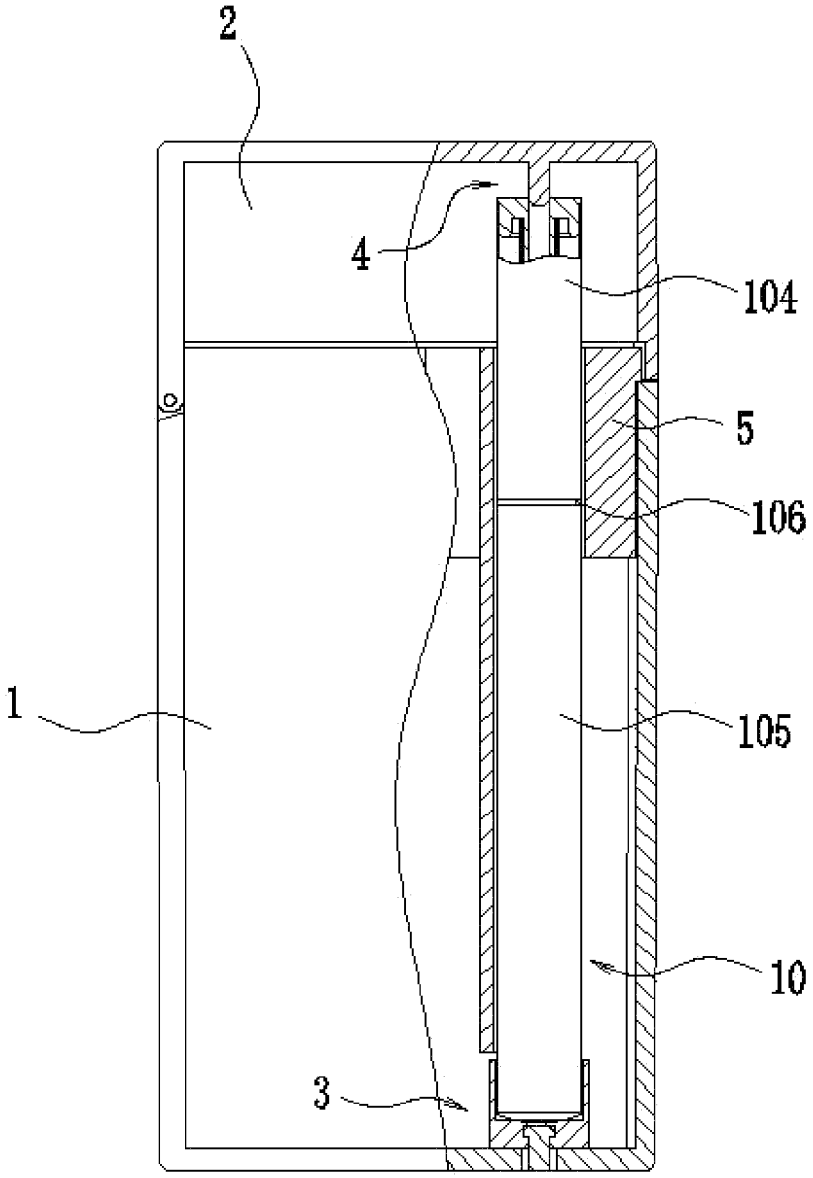
FIG. 11 is a structural schematic view of an electronic cigarette box of a seventh embodiment of the present invention.

Referring to FIG. 11, a seventh preferred embodiment of the present invention provides an electronic cigarette box, which differs from the electronic cigarette box provided by the first embodiment in the structures of the spiracles. In this embodiment, the electronic cigarette 10 comprises an atomizer 104 and a battery rod 105. The spiracles comprise a via vent 106 formed at a junction between the atomizer 104 and the battery rod 105, and the via vent 106 is configured for enabling the air to flow into the electronic cigarette 10. The sealing device comprises a third sealing device 5 sleeved on the electronic cigarette 10, and the third sealing device 5 adopts a hollow cylinder structure and mutually resists with the via vent 106.

The third sealing device 5 can be made of any one of plastic, rubber, and silicone. Using the above-mentioned materials achieves good sealing performance when the third sealing device 5 seals the via vent 106. According to the position of the via vent 106 in the electronic cigarette, the third sealing device 5 can be connected with either the first box body 1 or the second box body 2. The third sealing device 5 can also be integrated with either the first box body 1 or the second box body 2 to form an integrated structure. Understandably, the third sealing device 5 can also be connected with the first box body 1 or the second box body 2 using buckling connection, bonding, thread connection, welding, and so on. In this embodiment, the electronic cigarette box can adopt the structures of the first sealing device 3 and the second sealing device 4 described in any one selected from the first embodiment to the sixth embodiment.

An eighth preferred embodiment of the present invention provides an electronic cigarette box, which differs from the electronic cigarette box provided by the seventh embodiment in the construction of the spiracles. In this embodiment, the electronic cigarette 10 comprises a casing pipe and a lamp cap mounted at one end of the casing pipe. The spiracles are defined at a junction between the lamp cap and the casing pipe, and the spiracles are configured for enabling the air to flow into the electronic cigarette 10. The sealing devices are sleeved on the electronic cigarette 10 and resist with the spiracles. The sealing devices can adopt the same construction as the third sealing device 5.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette box configured for receiving electronic cigarettes defining spiracles for gas circulation, comprising a first box body and a second box body connected with the first box body;

wherein, the electronic cigarette box includes sealing devices corresponding to the spiracles, and the sealing devices are configured for sealing the spiracles;

wherein, the electronic cigarette comprises an inlet end received in the first box body; the spiracles comprise an inlet vent defined in the inlet end and configured for enabling air to flow into the electronic cigarette; the sealing devices comprise a first sealing device positioned between the electronic cigarette and the first box body; the first sealing device comprises a first sealing component connected with an inner wall of a bottom end of the first box body; a sealing groove opening towards one side of the electronic cigarette is defined in the first sealing component; and the inlet vent is positioned in the sealing groove; and wherein, a first card slot is defined in an end of the first sealing component that is near the inner wall of the bottom end of the first box body, and a first card buckle is formed on the inner wall of the bottom end of the first box body and buckles with the first card slot.

2. The electronic cigarette box according to claim 1, wherein, cross sections of both the first card slot and the first card buckle are T-shaped.

3. The electronic cigarette box according to claim 1, wherein, the first sealing component and the inner wall of the bottom end of the first box body are integrated together.

4. The electronic cigarette box according to claim 1, wherein, the first sealing component is made of anyone of plastic, silicone and rubber.

5. An electronic cigarette box configured for receiving electronic cigarettes, the electronic cigarettes defining spiracles for gas circulation, comprising a first box body and a second box body connected with the first box body;

wherein, the electronic cigarette box includes sealing devices corresponding to the spiracles, and the sealing devices are configured for sealing the spiracles;

wherein, the electronic cigarette comprises an outlet end that is far away from an inner wall of a bottom end of the first box body; the spiracles includes an outlet vent defined in the outlet end and configured to discharge smoke; the outlet vent extends along an axial direction of the electronic cigarette; and the sealing devices further comprise a second sealing device configured for sealing the outlet vent;

wherein, the second sealing device is a sealing column connected with the inner wall of the bottom end of the second box body; and the sealing column is received in the outlet vent.

6. The electronic cigarette box according to claim 5, wherein, the sealing column and the inner wall of the bottom end of the second box body are integrated together.

7. The electronic cigarette box according to claim 5, wherein, the sealing column is cylindrical, and matches with the outlet vent.

8. The electronic cigarette box according to claim 5, wherein, the sealing column is made of anyone of plastic, silicone and rubber.

9. The electronic cigarette box according to claim 5, wherein, the second sealing device comprises a second sealing component connected with the inner wall of the bottom end of the second box body; and one end of the second sealing component that is far away from the second box body resists with an end surface of the outlet end mutually.

10. The electronic cigarette box according to claim 9, wherein, a second card slot is defined in one end of the second sealing component that is near the inner wall of the bottom end of the second box body; and a second card buckle is formed on the inner wall of the bottom end of the second box body and buckles with the second card slot.

11. The electronic cigarette box according to claim 10, wherein, cross sections of both the second card slot and the second card buckle are T-shaped.

12. The electronic cigarette box according to claim 9, wherein, the second sealing component and the inner wall of the bottom end of the second box body are integrated together.

13. The electronic cigarette box according to claim 9, wherein, the second sealing component is made of anyone of plastic, silicone and rubber.

14. The electronic cigarette box according to claim 1, wherein, the electronic cigarette further comprises an atomizer and a battery rod; the spiracles further comprise a via vent formed at a junction between the atomizer and the battery rod and configured for enabling air to flow into the electronic cigarette; and the sealing devices further comprise a third sealing device sleeved on the electronic cigarette and resisting with the via vent.

15. The electronic cigarette box according to claim 1, wherein, the electronic cigarette further comprises a casing pipe and a lamp cap mounted at one end of the casing pipe; the spiracles are formed at a junction between the lamp cap and the casing pipe and are configured for enabling air to flow into the electronic cigarette; and the sealing devices are sleeved on the electronic cigarette and resist with the spiracles.

* * * * *